US005413135A

United States Patent [19]

Poole

[11] Patent Number: 5,413,135

[45] Date of Patent: May 9, 1995

[54] APPARATUS FOR SERVING COMESTIBLES AND METHOD OF ERECTING SAME

[76] Inventor: Barry S. Poole, 19114 Spring Blossom, Huntersville, N.C. 28078

[21] Appl. No.: 133,712

[22] Filed: Oct. 8, 1993

[51] Int. Cl.[6] ..... F16L 55/18

[52] U.S. Cl. ..... 137/15; 137/234.6; 137/357

[58] Field of Search ..... 137/234.6, 343, 356, 137/357, 15, 315

[56] References Cited

U.S. PATENT DOCUMENTS

| | | | |
|---|---|---|---|
| Re. 29,767 | 9/1978 | Futch . | |
| 1,624,267 | 4/1927 | Lyndon et al. . | |
| 2,021,544 | 11/1935 | Crown | 137/234.6 |
| 2,900,045 | 8/1959 | Conklin et al. . | |
| 3,170,541 | 2/1965 | Werner . | |
| 3,536,109 | 10/1970 | Ginsburgh et al. | 137/234.6 |
| 3,670,764 | 6/1972 | Tindal | 137/357 |
| 4,901,748 | 2/1990 | Shotmeyer | 137/357 |

*Primary Examiner*—A. Michael Chambers
*Attorney, Agent, or Firm*—Shefte, Pinckney & Sawyer

[57] ABSTRACT

A food and beverage serving apparatus that comprises multiple separate serving stations and a connecting superstructure all prefabricated to facilitate installation in an existing building's food service area with the serving stations spaced apart in a predetermined arrangement forming separate serving locations and the superstructure providing a means of unobtrusively routing utility connections, e.g., electricity, natural gas, water, etc., from remote utility sources to the serving stations, thereby enabling demolition or structural modification of the building area to be minimized and installation of the apparatus to be simplified.

16 Claims, 1 Drawing Sheet

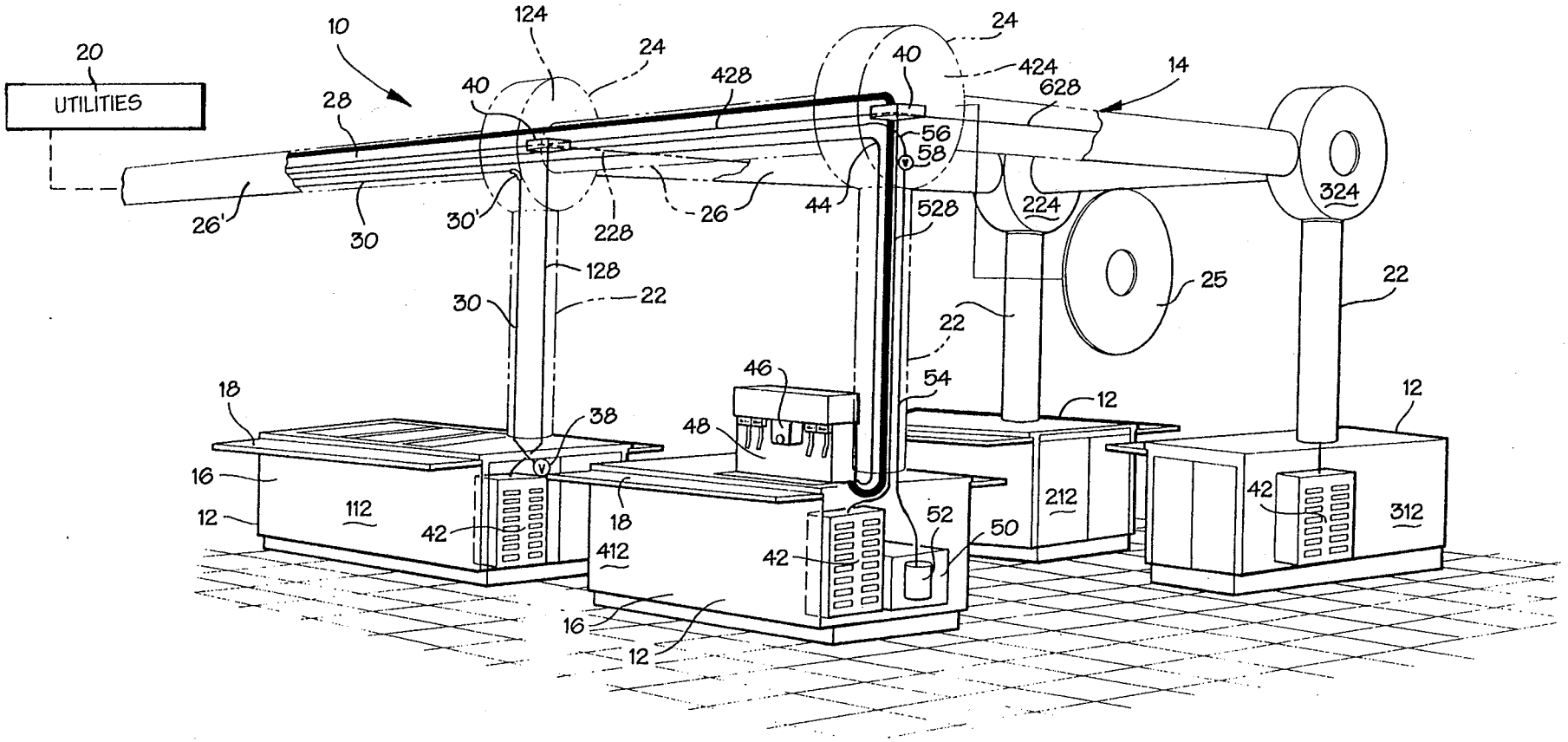
UTILITIES

APPARATUS FOR SERVING COMESTIBLES AND METHOD OF ERECTING SAME

BACKGROUND OF THE INVENTION

The present invention relates generally to the construction of large-scale systems for serving comestibles, i.e., food, beverages and the like, in relatively large volume to substantial numbers of customers, e.g., institutional and industrial cafeterias and like food service systems. More particularly, the present invention relates to a novel comestible serving apparatus and a method for erecting such apparatus which minimizes structural modifications and adaptations to a building structure housing the apparatus and further minimizes installation time.

The design, construction and installation of a large-scale food service facility necessarily requires that the construction and arrangement of the food service equipment must be specially tailored to the dimensions, configuration and utility sources available in the service area of the building structure in which the system is to be erected. Particularly in the case of equipping a pre-existing building structure with a food service facility or remodeling an existing food service facility, it is often necessary to structurally modify the building floors, walls and utility systems to accommodate a new food service facility. Further, it is common practice to fabricate and erect much of the food service equipment in place. Disadvantageously, these conventional techniques for constructing food service facilities are time consuming and expensive and, especially in the case of remodeling an existing facility, substantially disrupt the normal ongoing operation of the facility and in many cases can necessitate the complete shut-down of the facility during construction.

SUMMARY OF THE INVENTION

It is accordingly an object of the present invention to provide a novel comestible serving apparatus and a method by which the apparatus can be erected which minimize structural modification of building floors, walls and utilities and enable simplified and expeditious installation and erection of the apparatus.

Briefly summarized, comestible service apparatus according to the present invention basically comprise a plurality of distinct serving stations spaced apart from one another in a predetermined arrangement forming separate respective serving locations, a common superstructure connecting the plural serving stations to one another, and utility supply means contained within the superstructure for unobtrusively accomplishing utility connections between the serving stations and one or more utility sources.

The utility supply means may comprise electrical wiring for connection with a source of electricity, and/or plumbing for connection with a fluid supply source, e.g., water, beverages, and/or natural gas or a like fuel. In embodiments wherein collection of waste fluid will be necessary, e.g., where the apparatus is equipped with a water supply to one or more of the serving stations, the affected serving station or stations are equipped with a waste fluid pump and the associated utility supply means includes plumbing connecting the pump with a fluid collection means.

The superstructure preferably is fabricated of a network of upright conduits connected to and upstanding from the several serving stations and transverse conduits extending between and connected to the upright conduits at an elevated location above the serving stations. Junction housings are provided at the connection locations between the upright and transverse conduits, with each junction housing having a moveable cover for access to the utility supply means within the superstructure.

Each serving station preferably is constructed as a floor-standing housing containing food service equipment operated by the particular utility source routed to the serving station through the superstructure. The spaced-apart arrangement of the serving stations is predetermined to define appropriate customer traffic paths between the serving stations.

The described serving apparatus of the present invention enables a unique method to be carried out for erecting the apparatus within a predetermined service area of a building structure having one or more utility supply sources, essentially without requiring structural modification of building floors, walls and utilities. Basically, the method of the present invention involves the steps of initially prefabricating a plurality of distinct serving stations and also prefabricating a common superstructure for the several serving stations, based upon the dimensions and configuration of the service area, the intended arrangement of the serving stations within the service area, and the location of building structure's utility sources. To accomplish installation, the prefabricated serving stations are arranged within the service area of the building structure in a predetermined spaced-apart arrangement forming separate respective service locations, the superstructure is connected to each serving station and to the pre-existing utility supply source or sources of the building structure, and appropriate utility supply means is routed through the superstructure between the utility supply source and the several serving stations.

BRIEF DESCRIPTION OF THE DRAWING

The accompanying drawing is a perspective view schematically illustrating a comestible serving apparatus according to one preferred embodiment of the present invention.

DESCRIPTION OF THE PREFERRED EMBODIMENT

Referring now to the accompanying drawing, one embodiment of an apparatus for serving comestibles in a cafeteria-like setting in accordance with the present invention is shown generally at 10 and basically includes four distinct food or beverage serving stations 12 spaced apart from one another and connected by a common superstructure 14.

Each serving station 12 basically is constructed as a self-supported floor-standing cabinet-like housing 16 with one or more counters 18 extending outwardly from one or both longitudinal sides of the housing 16. Each serving station may be designated for service of a particular type of food or beverage. For example, in the embodiment illustrated, the serving station 112 is designated for service of hot cooked foods; the serving station 212 is designated as a salad bar for service of chilled foods, e.g., salads, fresh fruits and vegetables, etc.; the serving station 312 is designated for service of bread, desserts, pastries, etc.; and the serving station 412 is designated for beverage service. The spaced arrangement of the housings 16 for the serving stations 12 is predetermined in relation to the designated purposes of the serving stations 12 to define optimal customer traffic pathways between and around the serving stations 12 to best maximize and maintain customer movement.

The superstructure 14 serves to contain and route unobtrusively appropriate utility conduits from one or more remote utility source locations, shown only schematically at 20, to the several serving stations 12. The remote utility sources, e.g., the electrical, natural gas, and water mains for the building in which the serving stations 12 are situated, are preferably routed into the superstructure 14 at a common location as indicated in the drawing, e.g., through a single wall defining the cafeteria area, but of course those persons skilled in the art will recognize that such is not always possible and, therefore, the invention contemplates that the utility sources may be routed into the superstructure 14 at different locations.

The superstructure 14 essentially comprises plural upright conduits 22 corresponding in number to, and respectively connected to and upstanding from, the several serving stations 12, a junction housing 24 connected to the upper end of each upright conduit 22, and a plurality of horizontal conduits 26 extending transversely between and connected to the junction boxes 24, including at least one conduit 26' receiving the incoming and outgoing utility lines connected with the remote utility sources 20. The junction housings 24 provide an enclosure substantially larger than the conduits 22, 26, within which appropriate branch connections and fittings can be contained for routing the utility lines to each appropriate serving station 12. A removable cover 25 permits access to the interior of each housing 24.

By way of example, the drawing shows four incoming utility lines from the remote utility source location 20, an electrical cable 28 from the main electrical panel for the building; a natural gas line 30 from the building's natural gas main, a water pipe 32 from the water main for the building, and a bundle of beverage tubes 34 from remote beverage containers, e.g., syrup concentrates for colas and other sodas, carbonated water, etc. In addition, an outgoing water pipe 36 extends through the connecting conduit 26' to a point of connection with the building's sewage system.

At a first junction housing 124, an elbow 30' in the natural gas line 30 diverts the natural gas line 30 downwardly through the upright conduit 22 associated with the hot food serving station 112, within which the diverted natural gas line 30 is connected to a valve 38 at the entrance to a network of natural gas lines (not shown) extending to burners (also not shown) within the serving station 112. An electrical junction box 40 is also contained within the first junction housing 124 for routing a first branch 128 of the incoming electrical cable 28 downwardly to an electrical panel 42 in the hot food serving station 112 and also second and third branches 228, 428 to the junction housing 224 and 424 for the serving stations 212 and 412, respectively. The branch electrical line 228 extending to the junction housing 224 extends therethrough downwardly into and through the upright conduit 22 for the serving station 212, within which the branch electrical line 128 is connected to another electrical panel (not shown) within that serving station 212. The branch electrical line 428 extending to the junction housing 424 is connected therewithin to another electrical junction box 40 from which another branch electrical line 528 extends downwardly to an electrical panel 42 for the beverage serving station 412 and another branch line 628 extends to and through the junction housing 324 and therefrom downwardly through the upright conduit 22 to an electrical panel 42 within the serving station 312.

The incoming water pipe 32 extends horizontally through the conduit 26', the first junction housing 124 and the horizontal conduit 126 to the first junction housing 124, within which an elbow 44 diverts the water pipe 32 downwardly through the upright conduit 22 into the beverage serving station 412 wherein appropriate plumbing delivers the water to an appropriate tap or valve for water dispensing and also to an ice-making unit 46. Similarly, the bundle of beverage tubes 34 is directed through the horizontal conduits 26', 126 and diverted downwardly through the junction housing 424 into the beverage serving station 412, within which the beverage tubes 34 are connected to a commercial beverage dispensing unit 48. As is conventional, the beverage serving station 412 is equipped with an appropriate drainage system to divert water, beverage and ice spillage into a collection tank 50, which preferably contains a pump 52 for discharging the collected liquids. A discharge pipe 54 is connected to the pump 52 and extends upwardly through the conduit 22 to an elbow 56 which connects the discharge pipe 54 with the outgoing water pipe 36. Preferably, a check valve 58 is provided in the discharge pipe 54 immediately in advance of the elbow 56 to prevent back flow of discharged waste liquid into the collection tank 50.

As those persons skilled in the art will recognize and understand, the serving apparatus 10 of the present invention is susceptible to a wide variety of differing embodiments encompassing numerous combinations and arrangements of serving stations 12 and related superstructures 14, each of which necessarily will be conceived and designed for each different installation based upon the area, layout, available utility source locations, and other appropriate factors. One of the important advantages accomplished by the present invention is that, as a result of the use of the superstructure 14 to connect and delivery utilities to the several serving stations 12, minimal, if any, demolition or structural modification is necessary for the building area in which the apparatus is to be housed and, in turn, substantially all of the apparatus 10 may be prefabricated off-site based on the intended design and layout, thereby simplifying installation and minimizing installation time and any attendant disruption of the food service facility. As will be understood from the foregoing, the superstructure 14 may be designed to be decorative and aesthetically pleasing, as generally represented in the drawing, whereby the superstructure may be left substantially exposed within the serving area. Alternatively, the superstructure, with the exception of course of the upright conduits 22, may be substantially hidden within a false ceiling, when appropriate based upon prevailing design considerations.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of erecting a comestible serving apparatus within a pre-existing building structure having fixed structural walls, a fixed structural floor and a fixed structural ceiling collectively defining a comestible service area, and having at least one pre-existing utility supply source accessible through one of the walls, ceiling and floor, the method being characterized in that essentially no structural modification of building floors, ceilings walls and utility supply sources is required, the method comprising the steps of prefabricating a plurality of distinct serving stations, arranging the serving stations on the floor within the service area of the building structure in a predetermined spaced apart arrangement forming separate respective serving locations without structural modification of the floor, prefabricating a common superstructure for the plural serving stations, arranging the superstructure within the service area above the floor and below the ceiling and connecting the superstructure to each serving station and to the one of the walls, ceiling, and floor substantially without structural modification of any thereof for connecting the serving stations with the pre-existing utility supply source of the building structure, and routing utility supply means through the superstructure between the utility supply source and the serving stations to contain and enclose the utility supply means from view within the superstructure.

2. A method of erecting a comestible serving apparatus according to claim 1 wherein the step of arranging the serving stations comprises defining customer traffic paths between the serving stations.

3. A method of erecting a comestible serving apparatus according to claim 1 wherein the step of routing utility supply means through the superstructure comprises routing multiple utility supply lines to respective serving stations.

4. In combination with a pre-existing building structure having fixed structural walls, a fixed structural floor and a fixed structural ceiling collectively defining a comestible service area, and having at least one pre-existing utility source accessible through one of the walls, ceiling and floor, apparatus for serving comestibles comprising a serving station supported on the floor without structural modification thereof for forming a serving location, a superstructure disposed within the comestible serving area at an overhead spacing above the floor and below the ceiling and connected with the one of the walls, ceiling and floor substantially without structural modification of any thereof, and utility supply means enclosed from view within the superstructure for unobtrusively accomplishing utility connections between the serving station and the at least one utility source.

5. In combination with a pre-existing building structure having fixed structural walls, a fixed structural floor and a fixed structural ceiling collectively defining a comestible service area, and having at least one pre-existing utility source accessible through one of the walls, ceiling and floor, apparatus for serving comestibles comprising a plurality of distinct serving stations supported on the floor without structural modification thereof in spaced apart relation to one another in a predetermined arrangement forming separate respective serving locations, a common superstructure disposed within the comestible service area at an overhead spacing above the floor and below the ceiling without structural modification thereof for connecting the plural serving stations to one another, the superstructure being connected with the one of the walls, ceiling and floor substantially without structural modification thereof, and utility supply means contained and enclosed from view within the superstructure for unobtrusively accomplishing utility connections between the serving stations and the at least one utility source.

6. Apparatus for serving comestibles according to claim 5 wherein the utility supply means comprises electrical wiring for connection with a source of electricity.

7. Apparatus for serving comestibles according to claim 5 wherein the utility supply means comprises plumbing for connection with a source of fluid supply.

8. Apparatus for serving comestibles according to claim 7 wherein the plumbing is configured for conveyance of water.

9. Apparatus for serving comestibles according to claim 7 wherein at least one of the serving stations includes a waste fluid pump and the utility supply means comprises plumbing connected with the waste fluid pump for connection with a fluid collection means.

10. Apparatus for serving comestibles according to claim 7 wherein the plumbing is configured for conveyance of a beverage.

11. Apparatus for serving comestibles according to claim 7 wherein the plumbing is configured for conveyance of a fuel.

12. Apparatus for serving comestibles according to claim 5 wherein the superstructure comprises a first plurality of conduits each connected to and upstanding from a respective one of the serving stations and a second plurality of conduits extending transversely between and connected to the first conduits at an elevated location above the serving stations.

13. Apparatus for serving comestibles according to claim 12 wherein the superstructure comprises a plurality of junction housings each located at a respective connection between a first conduit and a second conduit.

14. Apparatus for serving comestibles according to claim 13 wherein each junction housing includes a movable cover for access to the utility supply means.

15. Apparatus for serving comestibles according to claim 5 wherein each serving station comprises a floor-standing housing containing means operated by the utility source.

16. Apparatus for serving comestibles according to claim 5 wherein the spaced-apart arrangement of the serving stations defines customer traffic paths between the serving stations.

* * * * *